United States Patent [19]

Driemeyer

[11] 4,448,554

[45] May 15, 1984

[54] SHEET FEEDING APPARATUS HAVING AN EXPANSIBLE PERIPHERY

[75] Inventor: Reinhold G. F. Driemeyer, Waterloo, Canada

[73] Assignee: NCR Canada Ltd - NCR Canada Ltee, Mississauga, Canada

[21] Appl. No.: 333,149

[22] Filed: Dec. 21, 1981

[51] Int. Cl.[3] ..... B61J 3/02

[52] U.S. Cl. ..... 400/124; 226/175; 226/191; 271/274

[58] Field of Search ..... 271/272, 273, 274; 226/175, 191; 400/124

[56] References Cited

U.S. PATENT DOCUMENTS

| | | | |
|---|---|---|---|
| 1,085,908 | 2/1914 | Hoe | 226/175 |
| 2,341,636 | 2/1944 | Luehrs | 226/175 |
| 2,428,316 | 9/1947 | Minkow | 226/191 |
| 3,178,173 | 4/1965 | Kalman | 271/28 |
| 3,360,099 | 12/1967 | Barr | 271/184 X |
| 4,279,496 | 7/1981 | Silverberg | 355/3 BE |

*Primary Examiner*—Richard A. Schacher
*Attorney, Agent, or Firm*—J. T. Cavender; Albert L. Sessler, Jr.; Elmer Wargo

[57] ABSTRACT

An apparatus having a track for guiding a sheet therealong and means for feeding a sheet along the track. The feeding means includes a rotatable member having a shaft mounted for rotation, with the rotatable member having a driving periphery extending into the track. The feeding means also includes a coupling unit and means for rotatably mounting the coupling unit at the track, with the coupling unit having an expansible periphery. Also provided is a means including an endless coiled spring for selectively moving the expansible periphery between a first position in which the expansible periphery is uncoupled from the driving periphery and a second position in which the expansible periphery is expanded to form a driving coupling with the driving periphery of the rotatable member to feed a sheet positioned therebetween along the track when the rotatable member is rotated.

15 Claims, 4 Drawing Figures

18
14
16
52
76
78
18
48
36
86
122
90
46
100
94
48-1
100
96
96
50
38
124
98
148
22
110
106
24
20
142
144
104
102

SHEET FEEDING APPARATUS HAVING AN EXPANSIBLE PERIPHERY

BACKGROUND OF THE INVENTION

This invention relates to a sheet feeding apparatus, and in a preferred embodiment thereof, it is part of a printing apparatus.

In certain business operations, such as banking operations, for example, it is necessary to move documents or sheets such as checks, deposit slips, and the like along a track to a utilization apparatus such as a printer or encoder. In one such operation, the sheets such as checks and deposit slips are moved along their lower edges in the track to an encoder which prints or encodes certain data on one side of the checks, for example, while they are moved in the track in printing relationship with the encoder by a feeding mechanism located at the encoder.

One of the problems with prior art apparatuses of the type described in the previous paragraph is they were not rigid enough to withstand the forces encountered at high printing rates, especially when the encoder utilized a wire matrix printer. For example, when the wire plungers of the printer impacted against the printer's platen at high rates of speed, the platen tended to deflect or oscillate. Because the wire plungers advance a distance of only about ½ millimeter during actuation thereof, if the platen is in a deflected position at this time, poor printing results.

SUMMARY OF THE INVENTION

This invention relates to an apparatus comprising: means for guiding a sheet therealong and means for feeding a sheet along said track; said feeding means comprising a rotatable member having a shaft mounted for rotation; said rotatable member having a driving periphery extending into said guiding means; a coupling unit; means for rotatably mounting said coupling unit at said guiding means; said coupling unit having an expansible periphery; and means for selectively moving said expansible periphery between a first position in which said expansible periphery is uncoupled from said driving periphery and a second position in which said expansible periphery is expanded to form a driving coupling with said driving periphery of said rotatable member to feed a sheet positioned therebetween along said guiding means when said rotatable member is rotated.

When the named apparatus is used in a printing environment, for example, a rotatable platen may be mounted on the coupling unit for rotation therewith to cooperate with a printer located thereat.

The apparatus of this invention is rigid in construction and economical to produce.

Another advantage of the apparatus of this invention is that the apparatus can be serviced without having to disassemble the means for guiding the sheets.

These advantages and others will become more readily understood in connection with the following specification, claims, and drawing.

DETAILED DESCRIPTION OF THE INVENTION

Figure 1:
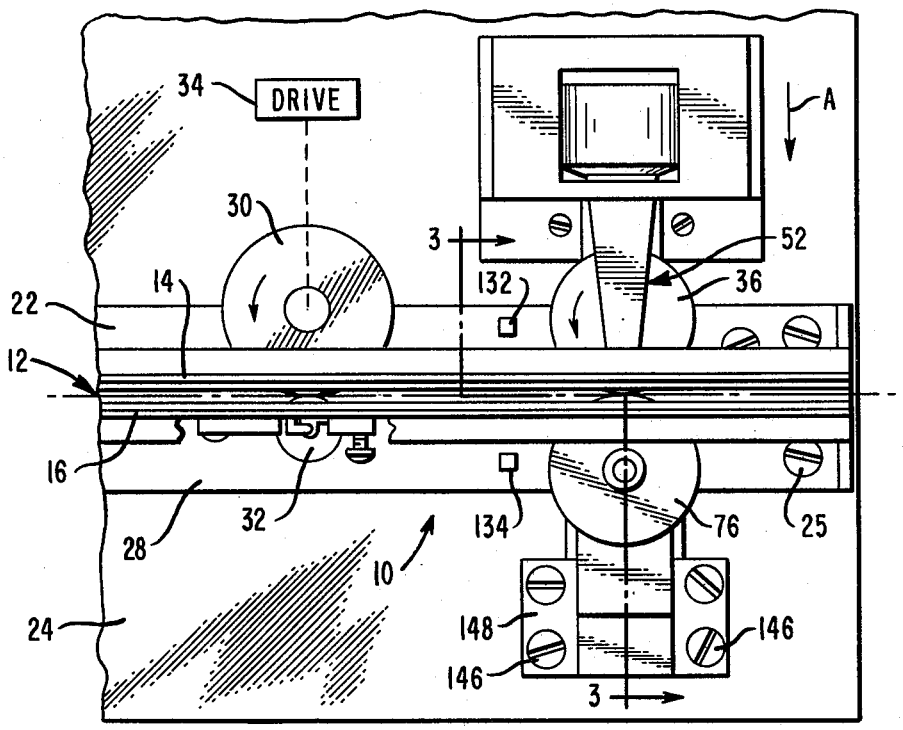
FIG. 1 is a plan view of a preferred embodiment of this invention as used in a printing environment.
Figure 3:
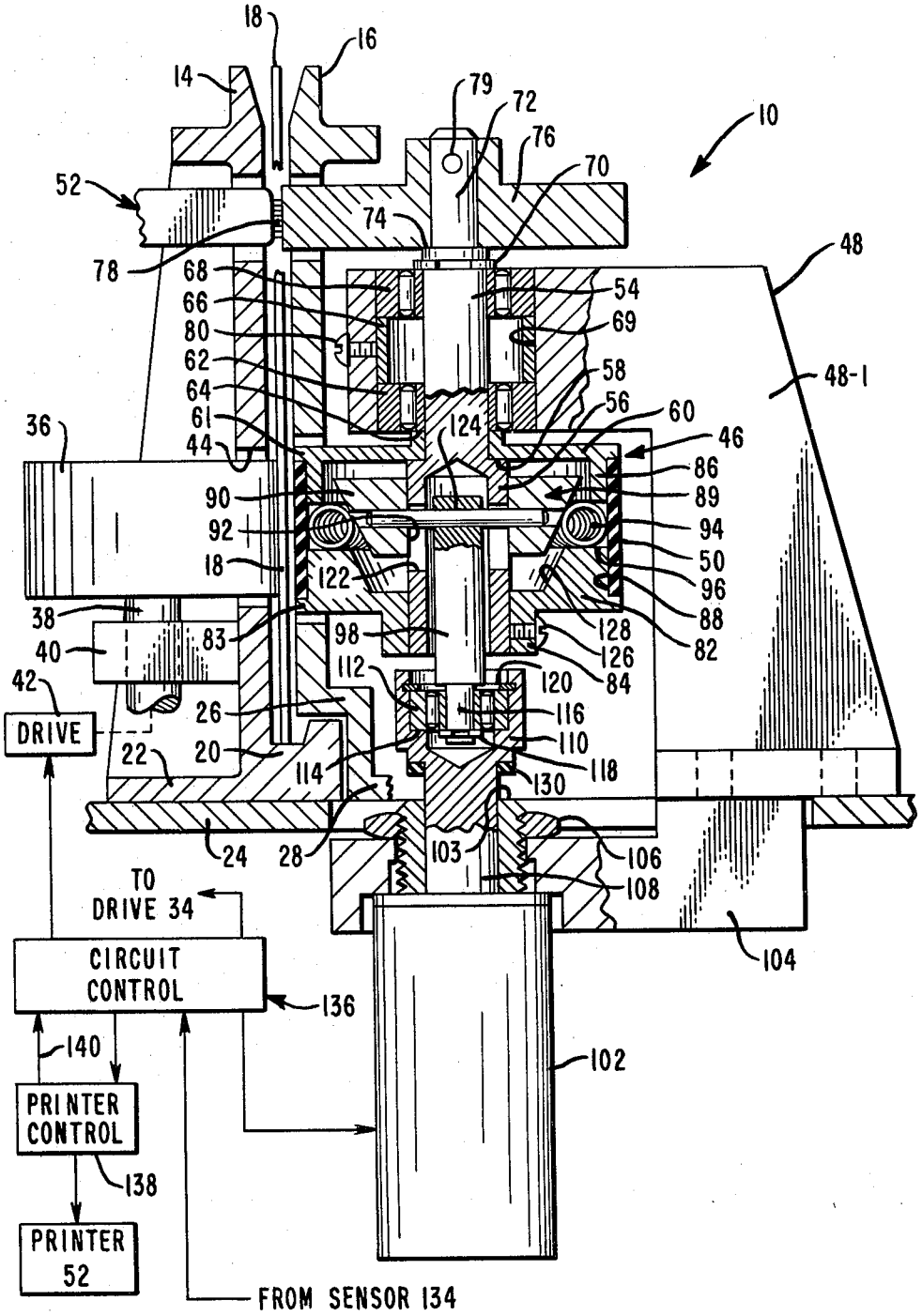
FIG. 3 is a cross-sectional view, taken along line 3—3 of FIG. 1, to show additional details of a coupling unit having an expansible periphery, with the periphery being shown in a non-expanded or in an uncoupled relationship with the drive roller and with a circuit control shown in schematic form thereon.

FIG. 1 is a plan view showing a preferred embodiment of the apparatus of this invention which is designated generally as 10. The apparatus 10 includes a means for guiding a sheet therealong which shall be referred to as a track 12. The track 12 includes a first side wall 14 and a second side wall 16 which are spaced apart in parallel relationship to guide a sheet 18 therebetween as is best shown in FIG. 3.

The side wall 14 (FIG. 3) has a trough portion 20 formed thereon to receive the bottom edge of the sheet 18, and it also has a flange 22 to enable it to be secured to a mounting plate 24 and to be upstanding therefrom. The sidewall 16 has an offset portion 26 formed therein to accommodate the trough portion 20 and to enable a flange portion 28 (joined to the offset portion 26) to be secured to the mounting plate 24 by fasteners like 25 (FIG. 1).

A conventional drive roller 30 (FIG. 1) located on one side of the track 12, and its associated pinch roller 32, located on the opposite side of track 12, cooperate to advance or move a sheet like 18 along the track 12. The drive roller 30 is rotatably supported on the side wall 14 by a conventional bearing (not shown) and is rotated by a conventional drive 34 (shown only diagrammatically in FIG. 1) to advance a sheet like 18 to the right or downstream, as viewed in FIG. 1.

The apparatus 10 also includes a drive roller 36 (FIG. 3) whose driving shaft 38 is rotatably supported on the side wall 14 by a bearing 40. The driving shaft 38 is rotated by a conventional drive 42 shown only schematically. The drive 42 may consist of a conventional motor, and driving pulleys and belts (not shown) which are operatively coupled to the drive shaft 38 to rotate the drive roller 36 in a counterclockwise direction as viewed in FIG. 1. The drive roller 36 has a portion of its periphery passing through an opening 44 in the side wall 14 so that the periphery extends into the space between the side walls 14 and 16.

Figure 4:
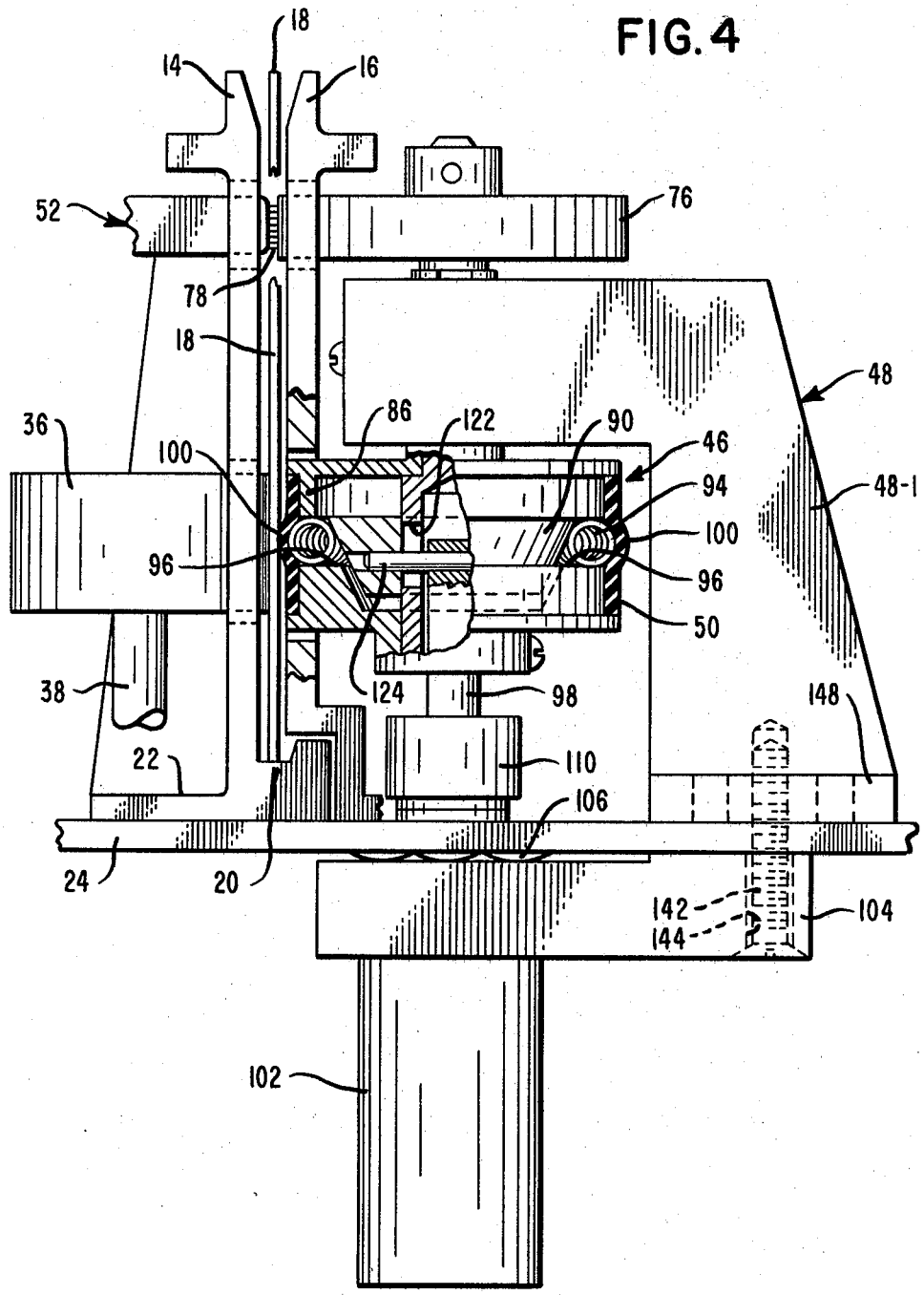
FIG. 4 is a view generally similar to FIG. 3 but showing the periphery of the coupling unit in an expanded condition for forming a driving coupling with the drive roller to feed a sheet therebetween.

The apparatus 10 also includes a coupling unit designated generally as 46 and is best shown in FIGS. 3 and 4. The coupling unit 46 is rotatably supported in a "C"-shaped support which is designated generally as 48, and which is secured to the mounting plate 24.

The coupling unit 46 has an expansible periphery 50 which is shown in a first position in FIG. 3 in which position it is uncoupled from the drive roller 36; this means that the drive roller 36 will not assist in propelling or feeding a sheet like 18 along the track. In this situation, the drive roller 30, located further upstream in the track 12 from the drive roller 36, provides the impetus for moving the sheet along the track 12 past the drive roller 36, where additional drive rollers (like 30 but not shown) are used to move the sheet further downstream along the track 12.

Figure 2:
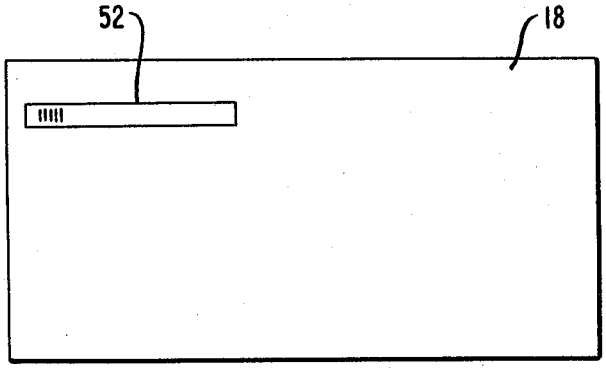
FIG. 2 is a side view in elevation of a document or sheet with certain printing or encoding shown on one side of the sheet as seen from the direction A of FIG. 1.

Earlier herein it was stated that a preferred form of the apparatus 10 related to a printing environment. The apparatus 10 is shown in FIGS. 1–3 in association with a printer designated generally as 52. When printing is to be effected, the rate of feeding a sheet like 18 in operative association with the printer 52 is slower than the rate of feeding a sheet along the track generally. For example, in the embodiment described, the feeding rate during printing is about 810 millimeters per second, and the feeding rate effected by drive roller 30, for example, is about 2641 millimeters per second. With these rates of feeding and with an amount of printing along a line 52 on the sheet 18 in FIG. 2 being about 44 millimeters, the throughput of sheets through the apparatus 10 is about 200 documents or sheets per minute.

It should be noted that drive roller 30 and drive roller 36 are constantly rotated at the necessary rotational speeds to effect the linear feeding rates mentioned in the previous paragraph. Naturally, these rates could be varied to suit different applications. The drive roller 30 and its associated pinch roller 32 cooperate to provide what is considered a "soft drive", while the drive roller 36 and the expansible periphery 50 of the coupling unit 46 cooperate to provide what is considered a "hard drive". Stated another way, the coefficient of friction between the drive roller 36 and the expansible periphery 50 is greater than that between the drive roller 30 and its associated pinch roller 32. This means that when a sheet 18 is gripped and moved by drive roller 36 and the coupling unit 46, the drive roller 30 will "slip" on the surface of the sheet 18.

Returning to the description of the coupling unit 46, the means for rotatably mounting the coupling unit 46 in the support 48 includes a shaft member 54 (FIG. 3) having an enlarged, cylindrical, tubular portion 56 with an annular shoulder 58 on one end thereof and an open end at the opposite end thereof. An upper, cylindrically-shaped, rim member 60, having a central aperture, is press fitted onto shaft member 54 and abuts against the shoulder 58 as shown in FIG. 3. Thereafter, bearing 62 is positioned on the shaft member 54 to abut against the annular shoulder 64 of the upper rim member 60. An annular sleeve 66 is positioned between bearing 62 and bearing 68.

As seen in FIG. 3, the bearings 62 and 68, along with the bushing 66 therebetween are inserted in a hole 69 in the support 48 and are retained together by a "C"-shaped washer 70 which is fitted into a mating recess (not shown) on the shaft member 54. The shaft member 54 has a reduced diameter portion 72 providing an annular shoulder 74 against which a cylindrically shaped platen 76 abuts. The platen 76 is fixed to rotate with the shaft 54 and the coupling member 46 by a fastener 79. A feature of this invention is that the platen 76 may be adjusted axially on the reduced diameter portion 72 so as to align it with the wire plungers 78 of the print head 52, and after alignment, it may be fixed relative to the print wires 78 by a locking screw 80 which is actually displaced about 90 degrees from the position shown to facilitate the adjustment thereof.

The coupling unit 46 (FIG. 3) also includes a lower rim member 82 having a central sleeve portion 84 which is mounted on the tubular portion 56. The upper rim member 60 has a peripheral skirt 86 depending therefrom, and which skirt 86 is aligned with the peripheral wall 88 (on the lower rim member 84) to receive a large elastic band which forms the expansible periphery 50 alluded to earlier herein. The upper rim member 60 has an annular shoulder 61 thereon and the lower rim member 82 similarly has an annular shoulder 83 thereon (FIG. 3) to retain thereon the large elastic band forming the expansible periphery 50.

The means 89 for moving the expansible periphery 50 between the first position shown in FIG. 3 and the second position shown in FIG. 4 is best shown in FIG. 3, and it includes the wedge member 90 having a central aperture 92 enabling it to be slidably mounted on the outside diameter of the tubular portion 56. The wedge member 90 has the shape of an inverted frustrum of a cone. Also included in the moving means 89 is a coiled spring 94 whose ends are joined to form a circle and which spring is positioned on the annular face 96 of the lower rim member 82. The spring 94 is biased to contract in diameter and thereby permit the expansible periphery 50 to assume the first position shown in FIG. 3. In this position, the expansible periphery 50 is uncoupled from the drive roller 36 so that a sheet 18 may freely pass therebetween, being driven by the upstream drive roller 30 as previously explained.

When the expansible periphery 50 of the coupling member 46 is to be moved to the second position mentioned, the wedge member 90 is moved downwardly (as viewed in FIG. 4) by means including the shaft 98, causing the diameter of the spring 94 to increase. When the diameter of the spring 94 increases, it expands through the opening between skirt 86 and the annular face 96, forming a bulge 100 in the periphery 50, thereby increasing the effective working diameter of the coupling unit 46 to form a driving coupling between it and the drive roller 36 to advance or feed the sheet 18 therebetween in printing relationship with the printer 52.

The wedge member 90 is moved to the position shown in FIG. 4 by a solenoid 102 having linkage connecting it with the shaft 98. The solenoid 102 is secured to the leg 104 of the support 48 by a threaded nut 106. The operating plunger 108 (FIG. 3) of the solenoid 102 has a cylindrically-shaped, tubular portion 110 formed on one end thereof, and a bearing 112 is positioned therein to abut against an annular shoulder 114 within the tubular portion 110. The bearing 112 is retained on the lower end 116 of the shaft 98 (which end 116 is reduced in diameter) by a "C"-shaped washer or fastener 118, and the bearing 112 is retained on the upper end by an expandible washer 120 which is retained in a mating annular recess in the tubular portion 110.

The tubular shaft portion 56 (FIG. 3) has two diametrically opposed elongated slots 122 therein, and the shaft 98 and the wedge member 90 have aligned holes therein to permit a pin 124 to be inserted through said holes and the slots 122 (when the coupling member 46 is in the position shown in FIG. 3) in the tubular portion 56 and through the shaft 98 (but not protruding from either end of the holes in the wedge member 90) to form a rotating, driving connection therebetween. This connection permits the coupling member 46 to be rotated in cooperation with the drive roller 36 when the solenoid 102 is energized to pull the wedge member 90 downwardly as viewed in FIG. 4 to expand the expansible periphery 50 as previously described.

The lower rim member 82 (FIG. 3) may be adjusted axially on tubular shaft portion 56 relative to the upper rim member 60 and fixed on the portion 56 by the fastener 126 to provide adjustment for the positioning of the spring 94. The wedge member 90 has an angle of 60 degrees for the conical surface, and the lower rim member 82 has a mating recess 128 therein to enable the wedge member 90 to advance therein when the solenoid 102 is energized. A resilient washer 130 is positioned around the operating plunger 108 of the solenoid 102 to avoid metal to metal contact between the lower end of tubular portion 110 and the top surface 103 of the threaded portion of the solenoid 102, thereby eliminating a source of noise. When the solenoid 102 is de-energized, the contracting spring 94 exerts an upward force on the wedge member 90, and via pin 124 and the shaft 98, the spring 94 causes the operating plunger 108 of the solenoid 102 to return to the position shown in FIG. 3.

The apparatus 10 (FIG. 1) also has a source of light 132 positioned on one side of the track 12 and an associated light sensor 134 positioned on the opposite side thereof to detect the leading edge of a sheet 18 as it approaches the printer 52. When printing is to be effected on the sheet 18, a conventional circuit control 136 (FIG. 3) energizes the solenoid 102 to move the coupling member 46 to the second position as previously described to expand the expansible periphery 50 to form the driving connection between it and the drive roller 36 to drive the sheet 18 at the appropriate speed for printing by the printer 52. A conventional printer control 138, operatively coupled to the circuit control 136, performs the necessary formatting of data to be printed to energize the wire plungers 78 of the printer 52 to print the data in bar codes or characters, for example, on the sheet 18 as shown in FIG. 2. The change of state in sensor 134, which results when the trailing edge of the sheet like 18 passes thereby, may be used to de-energize the solenoid 102, for example, or the printer control 138 may provide an end of printing signal on conductor 40 (FIG. 3) to the circuit control 136 to deenergize the solenoid 102, permitting drive rollers (not shown) which are located downstream from the drive roller 36 to move the sheet 18 further downstream along track 12 at the faster rate provided by these drive rollers like drive roller 30. The drives 42 and 34 are also under the control of the circuit control 136.

A ribbon (not shown) is positioned between the printer 52 and the platen 76. The wire plungers 78 (FIG. 3) are shown in their extended positions, and except when impacting against the ribbon and sheet 18, they are withdrawn into the printer 52. The ribbon and the sheet 18 provide enough resilience for the plungers 78 to impact against the metal platen 76. As the platen 76 rotates with the coupling member 46, it provides a guiding effect in moving the sheets like 18 downstream.

The "C" shaped support 48, which is made of metal, provides the rigidity necessary to overcome the oscillation problem mentioned earlier herein with regard to the printing. To facilitate the production of the support 48, it may be machined or formed in two pieces 48-1 and the leg 104, and these two pieces may be secured together by pins and fasteners like 142 (FIG. 4). The fasteners 142 pass through holes like hole 144 in leg 104 and are threadedly received in the piece 48-1. The support 48 is secured to mounting plate 24 by fasteners 146 (FIG. 1) which pass through its mounting flange 148 to the mounting plate 24.

Another feature of the apparatus 10 is that it may be adjusted and have maintenance performed on it without having to disturb the track 12.

I claim:

1. An apparatus comprising:

a track for guiding a sheet therealong and;

means for feeding a sheet along said track;

said feeding means comprising:

a rotatable member having a shaft mounted for rotation; said rotatable member having a driving periphery extending into said track;

a coupling unit;

means for rotatably mounting said coupling unit at said track;

said coupling unit having an expansible periphery; and means for selectively moving said expansible periphery between a first position in which said expansible periphery is uncoupled from said driving periphery and a second position in which said expansible periphery is expanded to form a driving coupling with said driving periphery of said rotatable member to feed a sheet positioned therebetween along said track when said rotatable member is rotated.

2. The apparatus as claimed in claim 1 in which said coupling unit includes a cylindrical member having a periphery and also having a resilient member mounted on the periphery of said cylindrical member to form said expansible periphery.

3. The apparatus as claimed in claim 1 in which said coupling unit includes an upper member and a lower member forming a peripheral wall with a space therebetween and also includes a first resilient member positioned on said coupling unit to expand into said space;

said coupling unit having a second resilient member positioned on said peripheral wall forming said expansible periphery; and said moving means including a member to expand said first resilient member into said space, causing said second resilient member to expand and to move into said second position to form said driving coupling when said moving means is moved in a first direction.

4. An apparatus comprising:

a track for guiding a sheet therealong and;

means for feeding a sheet along said track;

said feeding means comprising:

a rotatable member having a shaft mounted for rotation; said rotatable member having a driving periphery extending into said track;

a coupling unit;

means for rotatably mounting said coupling units at said track;

said coupling unit having an expansible periphery; and means for selectively moving said expansible periphery between a first position in which said expansible periphery is uncoupled from said driving periphery and a second position in which said expansible periphery is expanded to form a driving coupling with said driving periphery of said rotatable member to feed a sheet positioned therebetween along said track when said rotatable member is rotated;

said coupling unit including a cylindrical member having a periphery and also having a resilient member mounted on the periphery of said cylindrical member to form said expansible periphery;

said coupling unit including an upper member and a lower member forming a peripheral wall with a space therebetween and also including a first resilient member positioned on said coupling unit to expand into said space;

said coupling unit having a second resilient member positioned on said peripheral wall forming said expansible periphery; and said moving means including a member to expand said first resilient member into said space, causing said second resilient member to expand and to move into said second position to form said driving coupling when said moving means is moved in a first direction;

said resilient member being a spring formed into a circle having a diameter and said member of said moving means being wedge-shaped to expand said diameter of said spring formed into said circle when said moving means is moved in said first direction.

5. The apparatus as claimed in claim 4 in which said spring is an endless coiled metal spring which is biased to form a contracting diameter to bias said wedge-shaped member of said moving means in a second direction which is opposite to said first direction.

6. The apparatus as claimed in claim 5 in which said second resilient member is in the form of an endless rubber band which is positioned on said peripheral wall.

7. The apparatus as claimed in claim 4 in which said mounting means comprises:

a mounting plate having said track upstanding therefrom;

a rigid "C"-shaped support member secured to said mounting plate; and shaft means for rotatably supporting and positioning said coupling unit in said rigid "C"-shaped support member to enable said expansible periphery to form said driving coupling;

said moving means including an actuator and coupling means to enable said actuator to move said wedge-shaped member in said first direction to expand said diameter of said spring when said actuator is energized.

8. The apparatus as claimed in claim 7 in which said lower member has an annular face on which said spring is positioned.

9. The apparatus as claimed in claim 8 in which said coupling means includes means to enable said coupling unit to rotate when said wedge-shaped member is moved in said first direction, and in which said wedge-shaped member is generally conically shaped.

10. The apparatus as claimed in claim 7 further comprising a cylindrically-shaped platen fixed to said shaft means for rotation therewith and a printer positioned at said track in operative relation with said cylindrically-shaped platen for printing on a said sheet positioned therebetween.

11. The apparatus as claimed in claim 10 in which said printer is a wire matrix printer having wire plungers which impact against said cylindrically-shaped platen when actuated.

12. An apparatus comprising:

a track for guiding a sheet therealong;

first means including at least one first drive roller having a driving periphery for feeding a sheet along said track at a first rate of speed;

second means located downstream along said track with reference to said first means and also including a second drive roller for feeding a sheet along said track at a second rate of speed which is different from said first rate of speed;

said second drive roller having a driving periphery extending into said track;

said second means further comprising:

a coupling unit;

means for rotatably mounting said coupling unit at said track;

said coupling unit having an expansible periphery; and means for selectively moving said expansible periphery between a first position in which said expansible periphery is uncoupled from said driving periphery of said second drive roller and a second position in which said expansible periphery is expanded to form a driving coupling with said driving periphery of said second drive roller to feed a sheet positioned therebetween along said track when said second drive roller is rotated;

said driving periphery of said second drive roller having a coefficient of friction which is greater than the coefficient of friction of the driving periphery of said first drive roller to enable said second means to control the feeding rate of a said sheet in said track when both said first means and second means are in feeding relationship with the same said sheet.

13. The apparatus as claimed in claim 12 in which said coupling unit includes a cylindrical member having a periphery and also having a resilient member mounted on the periphery of said cylindrical member to form said expansible periphery.

14. The apparatus as claimed in claim 12 in which said coupling unit includes an upper member and a lower member forming a peripheral wall with a space therebetween and also includes a resilient member positioned to expand into said space;

said coupling unit having a second resilient member positioned on said peripheral wall forming said expansible periphery; and said moving means including a member to expand said first resilient member into said space, causing said second resilient member to expand and to move into said second position to form said driving coupling when said moving means is moved in a first direction.

15. The apparatus as claimed in claim 14 in which said second means has a printer associated therewith and in which said second rate of speed is slower than said first rate of speed to enable said printer to be in printing relationship with a said sheet being fed by said second means; and in which said resilient member is a spring formed into a circle having a diameter and said member of said moving means is wedge-shaped to expand said diameter of said spring formed into said circle when said moving means is moved in said first direction.

* * * * *